US008132289B2

(12) United States Patent
Hahn

(10) Patent No.: US 8,132,289 B2
(45) Date of Patent: Mar. 13, 2012

(54) LOCKING DEVICE FOR TELESCOPING POLE AND APPLIANCE PROVIDED WITH SUCH A LOCKING DEVICE

(75) Inventor: Matthias Hahn, Frankfurt (DE)

(73) Assignee: Rowenta Werke GmbH, Offenbach (DE)

( * ) Notice: Subject to any disclaimer, the term of this patent is extended or adjusted under 35 U.S.C. 154(b) by 409 days.

(21) Appl. No.: 12/409,829

(22) Filed: Mar. 24, 2009

(65) Prior Publication Data

US 2009/0241614 A1 Oct. 1, 2009

(30) Foreign Application Priority Data

Mar. 25, 2008 (FR) ..... 08 01600

(51) Int. Cl.
*B25G 1/04* (2006.01)

(52) U.S. Cl. ..... 16/113.1; 16/429; 16/405; 190/115; 15/144.4

(58) Field of Classification Search ..... 16/113.1, 16/405, 421, 429; 280/47.315, 47.371; 190/18 A, 190/115, 15 R; 15/144.4, 144.1
See application file for complete search history.

(56) References Cited

U.S. PATENT DOCUMENTS

| | | | | |
|---|---|---|---|---|
| 4,256,320 | A | 3/1981 | Hager | |
| 5,379,486 | A * | 1/1995 | Wang | 16/113.1 |
| 5,458,020 | A * | 10/1995 | Wang | 74/527 |
| 5,500,981 | A * | 3/1996 | Ho | 16/113.1 |
| 5,502,876 | A * | 4/1996 | Wang | 16/113.1 |
| 5,519,919 | A * | 5/1996 | Lee | 16/113.1 |
| 5,581,846 | A | 12/1996 | Wang | |
| 5,727,898 | A * | 3/1998 | Lu | 403/325 |
| 5,822,831 | A * | 10/1998 | Cheng | 16/405 |
| 5,876,048 | A * | 3/1999 | Lee | 280/47.315 |
| 6,141,828 | A * | 11/2000 | Kuo | 16/113.1 |
| 6,450,517 | B1 * | 9/2002 | Lee | 280/87.041 |
| 7,222,871 | B2 * | 5/2007 | Michelau et al. | 280/293 |
| 2008/0040953 | A1 * | 2/2008 | Leung | 38/77.6 |

FOREIGN PATENT DOCUMENTS

| | | |
|---|---|---|
| EP | 1 825 965 A | 8/2007 |
| GB | 2 149 358 A | 6/1985 |

* cited by examiner

*Primary Examiner* — Victor Batson
*Assistant Examiner* — Emily Morgan
(74) *Attorney, Agent, or Firm* — Browdy and Neimark, PLLC

(57) ABSTRACT

A locking device for a telescoping pole for use with a retractable handle system, the pole having at least one moveable section slideably mounted in a guide member having at least one opening. The locking device includes a body fixed to the movable section, a locking member carried by the body and movable between locking an unlocking positions, a rotatable lever carried by the body and pivotable between a release position, in which relative movement is permitted between the movable section and the guide member, and a blocking position, in which the lever comes to bear on the guide member and exerts a force assuring a transverse immobilization of the moveable section in the guide member. The lever is coupled to the locking member to be displaced toward the blocking position when the locking member is engaged in the opening under the force produced by a restoring element.

14 Claims, 3 Drawing Sheets

LOCKING DEVICE FOR TELESCOPING POLE AND APPLIANCE PROVIDED WITH SUCH A LOCKING DEVICE

BACKGROUND OF THE INVENTION

The present invention relates to a locking device for a telescoping pole, or rod, intended in particular to equip a retractable handle system. The invention relates more particularly to a locking device in which the telescoping pole has at least one moveable section slideably mounted in a guide member having at least one opening intended to receive a locking member carried by a body that is fixed to the moveable section.

U.S. Pat. No. 5,581,846 discloses a retractable handle system in which the handle is mounted on telescoping poles, or rods, each having a moveable section slideably mounted in a guide member. In this patent, the moveable section can be locked at different heights by means of a locking device having a locking member carried by the moveable section and engaging, under the force of a spring, in an opening provided on the telescoping guide member. To permit unlocking of each telescoping pole, there is provided a button that acts, through the intermediary of a rod means, on the locking member in a manner to displace the locking member in opposition to the spring and to disengage it from the opening.

Telescoping poles, or rods, of this type have, however, the drawback that they include a moveable section that must be mounted in its guide member with a sufficient play to avoid excessive rubbing between the pole and the guide member, in order to permit easy actuation of the pole by the user. As a result, there is a poor connection of the telescoping pole at the joint between the movable section and the guide member leading to a warping, or bending, of the telescoping pole when weight is applied on the handle and provoking possible clicking noises when this handle is subjected to vibrations.

French patent number 2 870 693 proposes a solution to these drawbacks by disposing a bearing in the guide member and mounting the moveable section substantially without play in this bearing.

However, such a solution requiring use of a bearing presents the drawback of being costly to produce.

BRIEF SUMMARY OF THE INVENTION

The present invention provides an improved solution that permits these drawbacks to be overcome and is simple and economical to produce.

For these purposes, the present invention provides a locking device for a telescoping pole intended notably to be used with a retractable handle system, the telescoping pole having at least one moveable section slideably mounted in a guide member having at least one opening, or recess, intended to receive a locking member carried by a body fixed to the moveable section, the locking member being brought to bear against the guide member by restoring, or biasing, means so that the locking member is automatically engaged in the opening when it is opposite the opening, wherein the body has a rotatable lever moveable between a release position and a blocking position, in which blocking position the rotatable lever comes to bear on the guide member and exerts a force assuring a transverse immobilization of the moveable section in the guide member, and wherein the rotatable lever is displaced by the locking member toward the blocking position when the locking member is engaged in the opening under the force produced by the restoring means.

According to another feature of the invention, in the release position, the rotatable lever does not exert any pressure on the guide member.

According to another feature of the invention, the locking member is displaced by a button in opposition to the restoring means into an unlocking position in which the locking member moves out of the opening, the lever being displaced toward the release position when the locking member is in the unlocking position.

According to yet another feature of the invention, the locking member is displaced in translation in the body along an axis transverse to the guide member, and the locking member has an inclined surface on which there comes to bear an actuator displaced by means of the unlocking button.

According to still another feature of the invention, the locking member has a lateral groove in which is engaged one end of the lever.

According to yet a further feature of the invention, the lever is mounted to pivot about an axis, the lever having a convex surface extending in proximity to the axis and forming a cam that comes to bear on the guide member when the lever is displaced with the locking member by the spring means.

The invention also relates to a household electric appliance having a rolling base and a transport handle mounted on at least one telescoping pole, wherein the telescoping pole has a locking device as described above.

According to a still further feature of the invention, the base has a steam generator and a wrinkle removal brush.

DETAILED DESCRIPTION OF THE INVENTION

Figure 1:
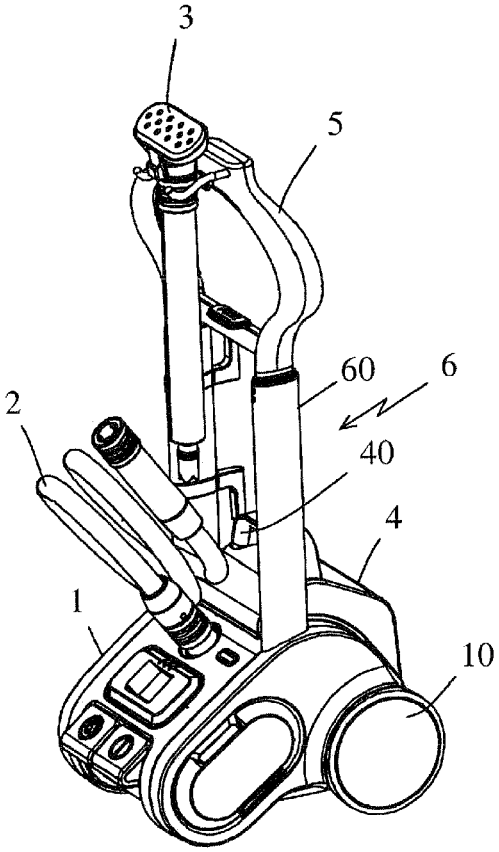
FIGS. 1 and 2 are perspective views of an ironing appliance having a cross bar, or handle member, mounted on telescoping poles provided with a locking device according to a preferred embodiment of the present invention.

In the various figures, only the elements necessary for an understanding of the invention have been shown. In order to facilitate understanding of the drawings, the same elements carry the same reference numerals from one figure to the other.

Figure 2:
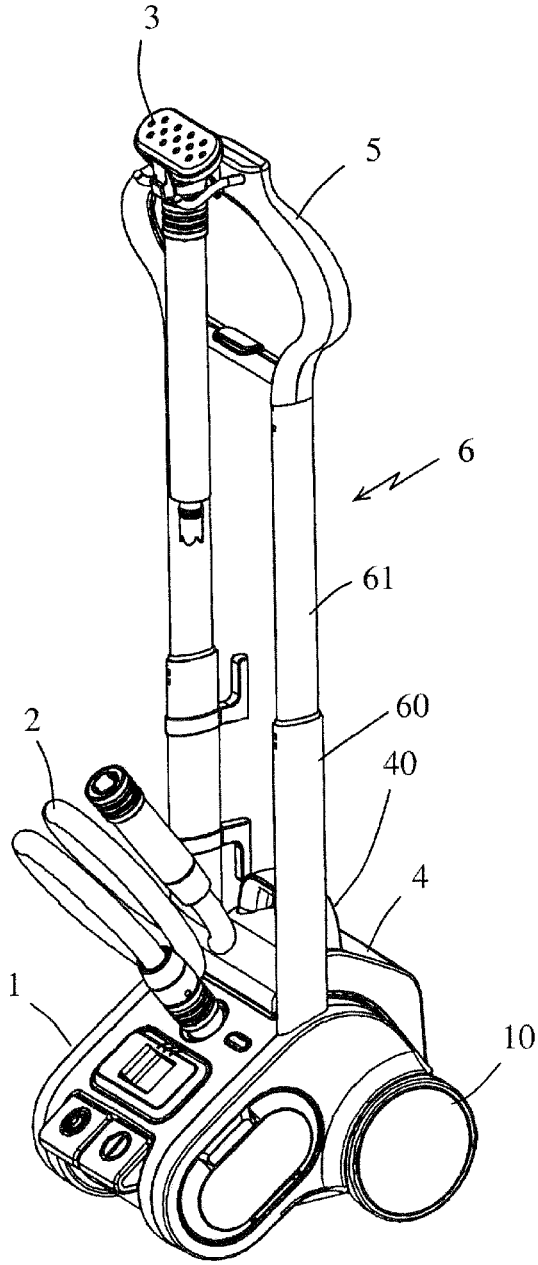

FIGS. 1 and 2 show a steam ironing appliance having a base 1 enclosing, in a manner known per se, a steam generator intended to be connected by a hose, or tube, to an accessory, such as a smoothing, or wrinkle removing, brush 3.

Base 1 is provided with two wheels, or castors, 10 disposed at the rear end of base 1. Otherwise, the components within base 1 are all known and conventional in the art.

Wheels 10 permit easy movement of the appliance by tilting the base toward the rear so that only wheels 10 rest in contact with the floor. Base 1 has a removable reservoir 4 disposed above the axis of wheels 10, reservoir 4 having a handle 40 at its upper end to allow easy extraction of the reservoir from base 1.

The appliance also has a handle structure composed of a handle 5 somewhat in the form of a coat hanger resting on two telescoping poles 6 that project downwardly from handle 5. Handle 5 can be in a retracted position, as shown in FIG. 1, permitting the space occupied by the appliance to be minimized for storage. Handle 5 can also occupy a deployed, or extended, position, as illustrated in FIG. 2, in which handle 5 is in a raised position suitable for supporting an article of clothing, such as a shirt or jacket. In this extended position, handle 5 can also be ideally utilized to roll the appliance on castors 10.

Figure 3:
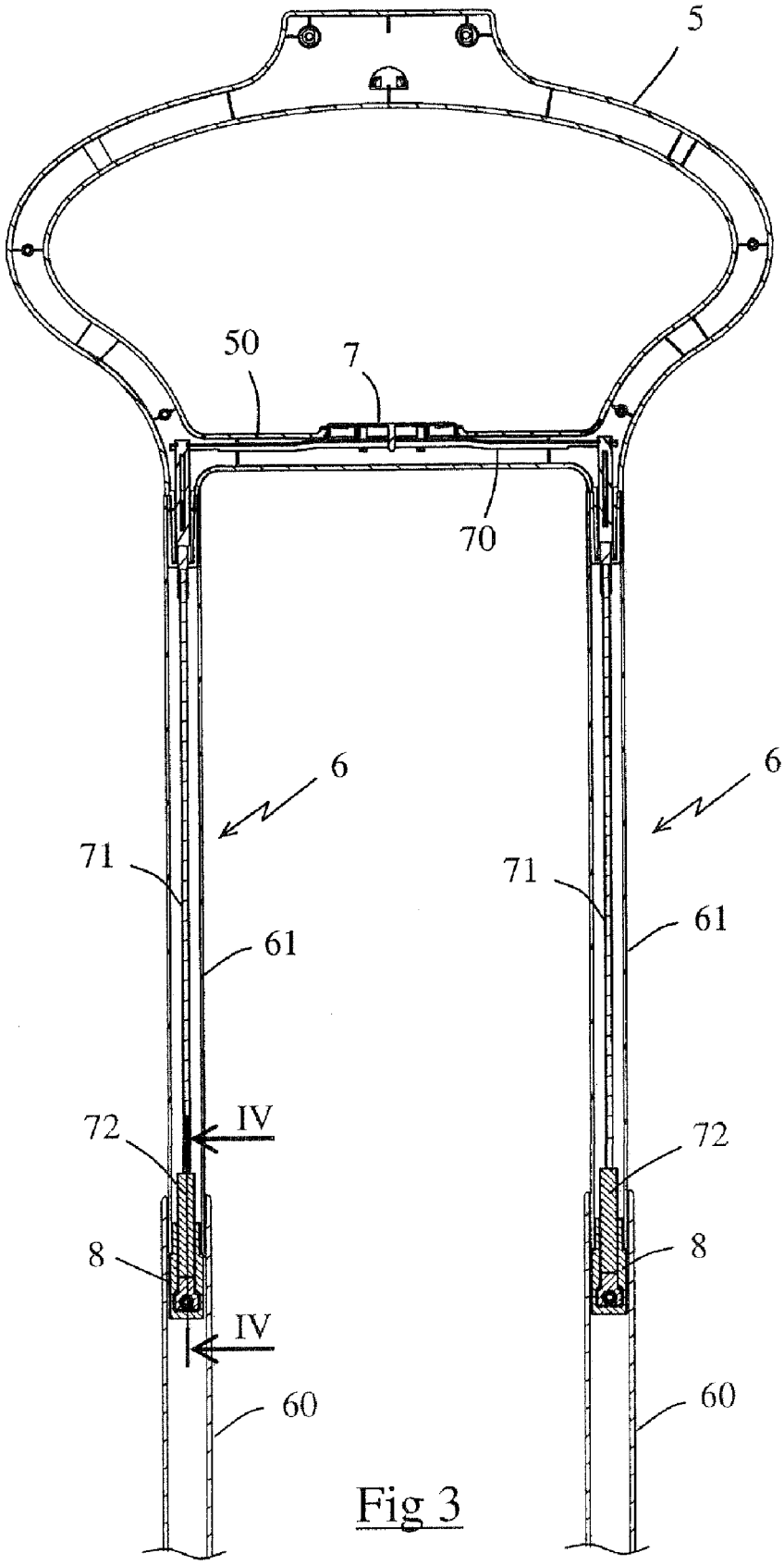
FIG. 3 is a cross-sectional elevational view of the retractable handle system of FIGS. 1 and 2.

The two telescoping poles 6 have identical structures, each pole having a hollow lower guide member 60 and a movable, or adjustable, section 61, and each pole may have an oblong, or elliptical, cross section in a plane perpendicular to the plane of FIG. 3, guide members 60 being fixed to base 1 and extending vertically therefrom. Each respective movable section 61 has a cross section complementary to that of the associated guide member 60 and is disposed to slide in its associated guide member 60. A play of the order of 1 mm is provided between guide member 60 and moveable section 61 in order to permit an unobstructed sliding movement of section 61 in its associated guide member 60.

As shown in FIG. 3, handle structure 5 includes an unlocking button 7 disposed on a cross bar 50 that extends under handle 5 and connects together the two telescoping poles 6. Button 7 is connected to a cross-piece, or strut, 70 extending within cross bar 50. Strut 70 is fixed at each of its ends to an actuating rod 71 mounted to be moveable in translation within a respective moveable section 61. Each actuating rod 71 has a lower end provided with a head 72 that constitutes an actuator arranged to act on a locking device, as shown in detail in FIGS. 4 and 5.

Figure 4:
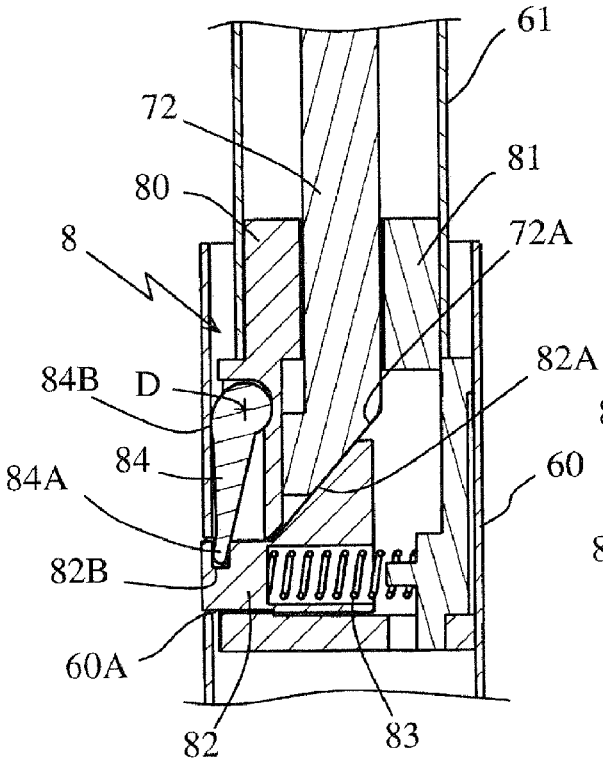
FIG. 4 is a cross-sectional view, to a larger scale, along the plane IV-IV of FIG. 3, showing a locking device according to the invention in the locking position.
Figure 5:
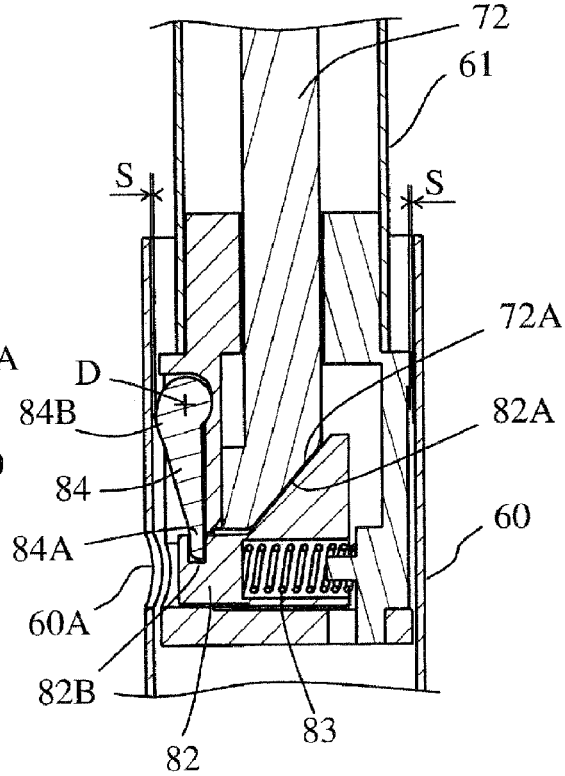
FIG. 5 is a view similar to that of FIG. 4, showing the locking device of FIG. 4 in the unlocking position.

As shown in FIGS. 4 and 5, the locking device includes a body 8 composed of two parts 80, 81 assembled with one another and disposed at the lower end of the moveable section 61. Body 8 encloses a locking member 82 that is displaceable transversely to the longitudinal direction of guide member 60 between a locking position, shown in FIG. 4, in which locking member 82 is inserted into a hole 60A provided for this purpose in guide member 60, and an unlocking position, illustrated in FIG. 5, in which locking member 82 is withdrawn from hole 60A.

Locking member 82 is urged by a spring 83 against guide member 60 so that locking member 82 will be inserted automatically into hole 60A at the moment that it comes in line with hole 60A during displacement of moveable section 61 in guide member 60. In a preferred manner, one hole 60A is located in proximity to the upper end of guide member 60 in a manner to permit locking of moveable section 61 in the deployed, or extended, position. Additional holes may be provided along guide member 60 to provide other locking positions.

Locking member 82 includes, in a manner known per se, an inclined plane 82A in which head 72 of actuating rod 71 comes to rest. Plane 82A is inclined in a manner such that a longitudinal displacement of actuating rod 71 toward locking member 82 provokes a transverse movement of locking member 82 in opposition to spring 83, as is illustrated in FIG. 5. The resulting withdrawal of locking member 82 from hole 60A then permits a free sliding movement of moveable section 61 in guide member 60. In an advantageous manner, head 72 at the lower end of actuating rod 71 is provided with an inclined surface 72A that comes to bear on, and is parallel to, inclined plane 82A of locking member 82.

In particular, according to the invention, the locking device also has a lever 84 that is mounted for pivoting movement between a release position shown in FIG. 5 and a blocking position shown in FIG. 4.

Lever 84 is mounted to pivot about an axis D carried by body 8 and lever 84 has a tapered free end 84A that is engaged in a lateral groove 82B of the locking member so that the end 84A of lever 84 is displaced from the release position to the blocking position when locking member 82 is engaged in hole 60A in response to the force produced by spring 83.

Preferably, lever 84 has, in proximity to its pivot axis D, a convex surface extending locally in the form of a spiral around axis D and thus forming a camming surface 84B that comes to bear against guide member 60 while exerting a pressure on that guide member when locking member 82 is pushed into hole 60A in response to the force produced by spring 83. The value of the pressure exerted by camming surface 84B on guide member 60 under the action of spring 83 can be adapted by experimentation by modifying the strength of spring 83 and/or the length of lever 84, and in particular the distance separating free end 84A from camming surface 84B.

The pressure exerted by the displacement of lever 84 toward the exterior of body 8 when locking member 82 is engaged in hole 60A provokes a lateral displacement of body 8 in guide member 60 in such a direction that the part of body 8 located across from lever 84 becomes pressed against guide member 60. This results in an elimination of the play between guide member 60 and body 8 when lever 84 is in the blocking position. The supporting strength of moveable section 61 is thus found to be greatly improved so that an article of clothing can be disposed on handle 5, which is in the form of a clothes hanger, without risk of bending, or warping, at the junction, or joint, between moveable section 61 and guide member 60. In addition, the appliance can also be pulled on wheels 10 by handle 5 without provoking rattling or clicking noises.

Conversely, when the user presses on unlocking button 7, this provokes a displacement of locking member 82 in opposition to spring 83 and rotation of lever 84 toward the interior of the body in such a manner that camming surface 84B no longer exerts any pressure on guide member 60. A play S (FIG. 5) is then reestablished between guide member 60 and body 8, which carries lever 84, in the release position, so that moveable section 61 can be freely displaced in guide member 60 to a new locking position.

Of course, the invention is not limited to the embodiment described and illustrated, which has been given only by way of non-limiting example. Modifications remain possible, particularly with respect to the construction of the various elements or by substitution of equivalent techniques, without departing from the framework of the present invention.

Thus, in an alternative embodiment, not shown, the telescoping poles could have several moveable sections sliding in one another, each moveable section having a locking device according to the invention, permitting it to be locked without play to the section or guide member to which it is attached.

The present invention relates to subject matter disclosed in French Application 08 01600, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A locking device for a telescoping pole for use with a retractable handle system, the telescoping pole having at least one moveable section slideably mounted in a guide member having at least one opening, said locking device comprising:

a body fixed to the movable section;

a locking member carried by said body, said locking member being movable relative to said body between a locking position, in which said locking member engages the opening to lock the movable section in position relative to the guide member, and an unlocking position, in which said locking member is disengaged from the opening to permit the movable section to be displaced relative to the guide member;

restoring means coupled to said locking member for urging said locking member into the locking position when said locking member is opposite the opening;

a rotatable lever carried by said body and pivotable between a release position, in which relative movement is permitted between the movable section and the guide member, and a blocking position, in which said rotatable lever comes to bear on the guide member and exerts a force assuring a transverse immobilization of the moveable section in the guide member, wherein said rotatable lever is coupled to said locking member to be displaced toward the blocking position when said locking member is engaged in the opening under the force produced by said restoring means.

2. The locking device according to claim 1, wherein said rotatable lever is constructed to not exert any pressure on the guide member when in the release position.

3. The locking device according to claim 2, further comprising an unlocking button coupled to said locking member, said button being operable to displace said locking member in opposition to said restoring means into the unlocking position, and wherein said rotatable lever is displaced toward the release position when said locking member is in the unlocking position.

4. The locking device according to claim 3, wherein:

said locking member is mounted for displacement in translation in said body along an axis transverse to the longitudinal dimension of said guide member;

said locking member has an inclined surface; and said locking device further comprises an actuator that comes to bear on said inclined surface and that is displaceable by operation of said unlocking button.

5. The locking device according to claim 4, wherein said rotatable lever has a free end and said locking member has a lateral groove in which said free end of said rotatable lever engages.

6. The locking device according to claim 5, wherein said rotatable lever is mounted to pivot about an axis, and said rotatable lever has a convex surface extending in proximity to the axis and forming a cam that comes to bear on the guide member when said rotatable lever is displaced with said locking member by said restoring means.

7. A household electric appliance comprising: a wheeled base; a transport handle mounted on at least one telescoping pole composed of at least one moveable section slideably mounted in a guide member having at least one opening, wherein said telescoping pole has a locking device as defined in claim 6.

8. The appliance according to claim 7, wherein said base comprises a steam generator and a wrinkle removal brush.

9. A household electric appliance comprising: a wheeled base; a transport handle mounted on at least one telescoping pole composed of at least one moveable section slideably mounted in a guide member having at least one opening, wherein said telescoping pole has a locking device as defined in claim 1.

10. The appliance according to claim 9, wherein said base comprises a steam generator and a wrinkle removal brush.

11. The locking device according to claim 1, further comprising an unlocking button coupled to said locking member, said button being operable to displace said locking member in opposition to said restoring means into the unlocking position, and wherein said rotatable lever is displaced toward the release position when said locking member is in the unlocking position.

12. The locking device according to claim 11, wherein:

said locking member is mounted for displacement in translation in said body along an axis transverse to the longitudinal dimension of said guide member;

said locking member has an inclined surface; and said locking device further comprises an actuator that comes to bear on said inclined surface and that is displaceable by operation of said unlocking button.

13. The locking device according to claim 1, wherein said rotatable lever has a free end and said locking member has a lateral groove in which said free end of said rotatable lever engages.

14. The locking device according to claim 1, wherein said rotatable lever is mounted to pivot about an axis, and said rotatable lever has a convex surface extending in proximity to the axis and forming a cam that comes to bear on the guide member when said rotatable lever is displaced with said locking member by said restoring means.

* * * * *